United States Patent [19]

Graham

[11] Patent Number: 4,606,247

[45] Date of Patent: Aug. 19, 1986

[54] VERSATILE CHAINED TOOL SET

[75] Inventor: Charles H. Graham, Salt Lake City, Utah

[73] Assignee: Professional Business Management Associates, North Salt Lake, Utah

[21] Appl. No.: 776,426

[22] Filed: Sep. 16, 1985

[51] Int. Cl.[4] ..... B25B 23/16

[52] U.S. Cl. ..... 81/177.6; 81/437; 81/177.8

[58] Field of Search ..... 81/177.6, 177.8, 437; 7/138

[56] References Cited

U.S. PATENT DOCUMENTS

| | | | |
|---|---|---|---|
| 384,592 | 6/1888 | Ross | 7/138 |
| 472,147 | 4/1892 | Sullivan | 81/437 |
| 992,913 | 5/1911 | Seils | 81/177.8 |
| 1,169,496 | 1/1916 | Knauff | 81/177.6 |
| 1,316,398 | 9/1919 | Steininger | 81/177.6 |
| 2,097,361 | 10/1937 | Bagley | 81/177.6 |
| 2,199,899 | 5/1940 | Watson | 81/437 |
| 2,426,763 | 9/1947 | Curtis | 81/177.8 |
| 2,504,345 | 4/1950 | Nellis | 7/138 |
| 2,951,405 | 9/1960 | Engquist | 81/177.8 |
| 3,039,339 | 6/1962 | Hanson | 81/177 |
| 3,188,895 | 6/1965 | Jones | 81/177 |
| 4,269,311 | 5/1981 | Rich | 81/177 |
| 4,384,499 | 5/1983 | Shockley | 81/440 |

FOREIGN PATENT DOCUMENTS

| | | | |
|---|---|---|---|
| 1240971 | 8/1960 | France | 81/124.5 |

*Primary Examiner*—James G. Smith

*Attorney, Agent, or Firm*—Workman, Nydegger & Jensen

[57] ABSTRACT

A versatile chained tool set having a plurality of tools consisting of any desired working tips such as an open-end wrench, a box-end wrench, a fractional or metric wrench, socket drives, spline drives, spanner wrenches, screwdrivers of all styles, or tools such as taps, easy outs, allen wrenches or other similar tools. Each tool is formed as part of a link and each link is joined to an adjacent tool link so that the various tools are chained together. When using one of the tools, the chain can be folded or collapsed to form a rigid and strong hand piece which can then be used to apply the torque or other force necessary to operate the tool.

68 Claims, 11 Drawing Figures

VERSATILE CHAINED TOOL SET

FIELD OF THE INVENTION

The present invention relates to hand tools, and more particularly to a set of tools wherein each tool is linked together to form a collapsible chain which can be used in selecting one of the tools, and which is used as a hand piece when performing work with a tool.

BACKGROUND OF THE INVENTION

Many types of tool sets have been devised over the years. For example, tools sets which provide multiple sizes of open-end wrenches, or tool sets which provide various size sockets together with a socket drive and ratchet, or which provide multiple types and sizes of screwdrivers, or various size allen wrenches or the like are common in the art. Frequently when a person is engaged in work, it is convenient or necessary to have different types and sizes of wrenches, screwdrivers or other such hand tools available. For example, at times, it may be necessary to use selected combinations of tools for certain jobs. However, this requires carrying a large number of tools, which is both inconvenient and sometimes impractical. Furthermore, often it is difficult to keep track of the various tools provided with a set, with the result that sometimes parts to the set become lost. Nothing can be more frustrating than not being able to find a particular size tool when it is needed for a job.

In summary, while it is convenient and often necessary to have various types of tool sets readily available on the job so that different sizes and kinds of tools such as wrenches, screwdrivers and the like will be readily accessible, it is inconvenient to have to carry numerous tools and it is also frequently difficult to keep track of the tools. Another problem frequently encountered is the difficulty required in changing from one tool to another within a given set. This often requires disconnecting and reconnecting parts, which may be cumbersome and time consuming.

OBJECTS AND BRIEF SUMMARY OF THE INVENTION

In view of the foregoing needs and problems arising in connection with the present state of the art, it is a primary object of the present invention to provide a versatile chained tool set which provides in a single hand piece a plurality of tools which can be changed in rapid succession from one tool to the other.

It is another object of the present invention to provide a versatile tool set in which various sizes and/or types of tools may be provided on a single hand piece so as to avoid any loose parts in the tool set which can be lost or misplaced.

Another important object of the present invention is to provide a versatile tool set in which the various tools can be rapidly interchanged without the need for removing, reconnecting or replacing parts on the hand piece.

Still another object of the present invention is to provide a versatile tool set which is formed as a single hand piece and which is both compact and durable.

Still another important object of the present invention is to provide a versatile tool set in which each of the tools are attached to a single hand piece and wherein special combinations of tools may be selected and attached to the hand piece for purposes of providing specific tool sets for any given special application which requires a certain combination of tools.

The foregoing and other objects and features are realized in the present invention, which comprises a versatile chained tool set. Briefly summarized, the chained tool set of this invention comprises a set of tools consisting of any desired working tips such as an open-end wrench, a box-end wrench, fractional or metric wrenches, socket drives, spline drives, spanner wrenches, screwdrivers of all styles, tools such as taps, easy outs, allen wrenches or other similar tools. Each tool is formed as part of a link and each link is joined to an adjacent tool link. When using one of the tools, the chain can be collapsed to form a rigid and strong hand piece which can be used to apply the torque or other force necessary to operate the tool. When interchanging one tool for another, the chain can be opened and rotated to select a new tool. The chained tool set is designed so that if desired any or all of the tool links can be disconnected one from the other so that new or different sized tools can be added into the chain, or so that worn tools can be removed and replaced.

Reference is next made to a brief description of the drawings, which illustrate several presently preferred embodiments of the present invention.

BRIEF DESCRIPTION OF THE DRAWINGS

Reference is next made to a detailed description of the presently preferred embodiments as illustrated in the above-described drawings, wherein like parts are designated with like numerals throughout.

DETAILED DESCRIPTION OF THE PRESENTLY PREFERRED EMBODIMENTS

Figure 1:
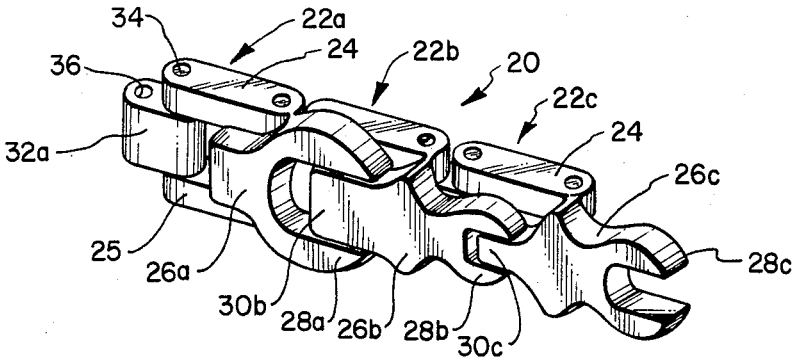
FIG. 1 is a perspective view in which a portion of a chained tool set constructed in accordance with the present invention has been depicted in order to illustrate the basic inventive concept of the present invention.
Figure 2:
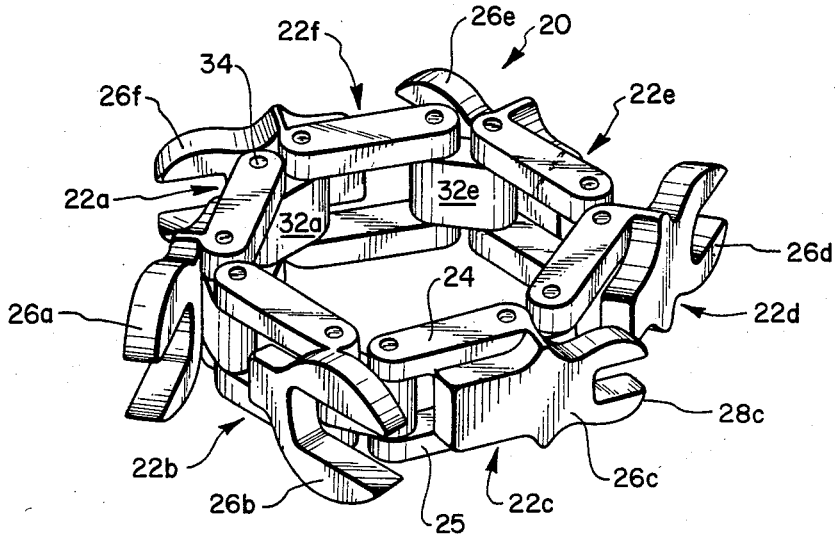
FIG. 2 is a perspective view of a complete chained tool set with the chain in an open configuration.

Referring first to FIGS. 1 and 2, one presently preferred embodiment of the chained tool set of the present invention is generally designated at 20. As shown in FIG. 2, the chained tool set 20 may be linked together to form an endless loop. In the alternative, the chained tool set 20 may be disconnected between a pair of adjacent links so as to form simply a straight chain, a portion of which is illustrated in FIG. 1. Either configuration is within the scope of the present invention.

Figure 9:
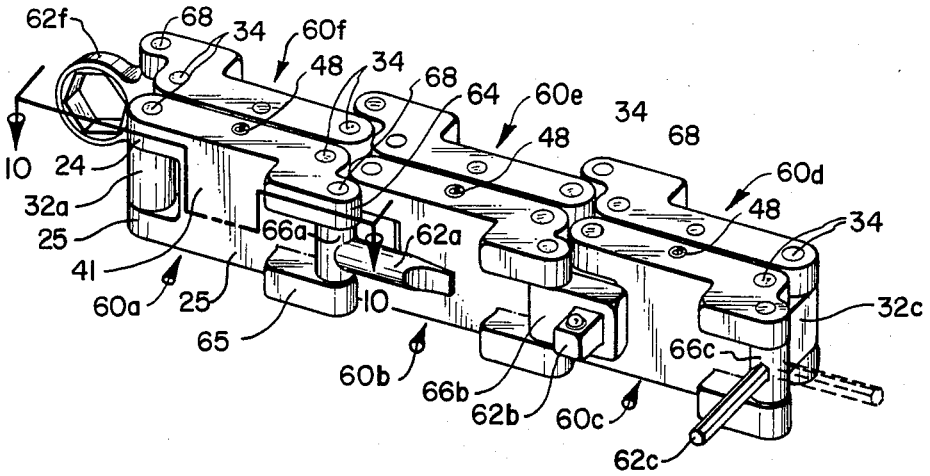
FIG. 9 is a perspective view illustrating still another embodiment of the chained tool set of the present invention in which different types of tools have been linked together to form the chain.
Figure 10:
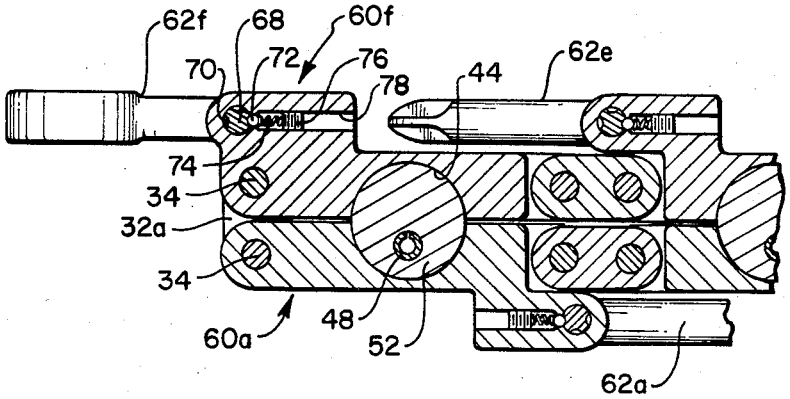
FIG. 10 is a cross-sectional view taken along line 10—10 of FIG. 9.

As shown best in FIGS. 1 and 2, the chained tool set 20 comprises a plurality of tool links generally designated at 22*a*–22*f*. Each of the tool links 22 may be essentially identically formed so as to provide the same type of tool with each tool having a different size, such as the open-end wrench set illustrated in FIGS. 1 and 2, or as hereinafter more fully described, each tool link 22 may be formed so as to provide a different type of tool such as illustrated in FIGS. 9 and 10 discussed below. The tool links 22 can be manufactured using any suitable method, such as casting, machining, drop forging, investment casting or centrifugal casting. The tools can be constructed of any material suitable for a particular job or application such as steel with a finish of chrome, zinc, nickel or the like. Plastics may be used in forming the tool links when they are to be used in applications such as assembling childrens' plastic toys or the like. In cases where factors such as strength and weight govern over cost considerations, materials such as titanium or high strength polymer materials may be used.

Figure 3:
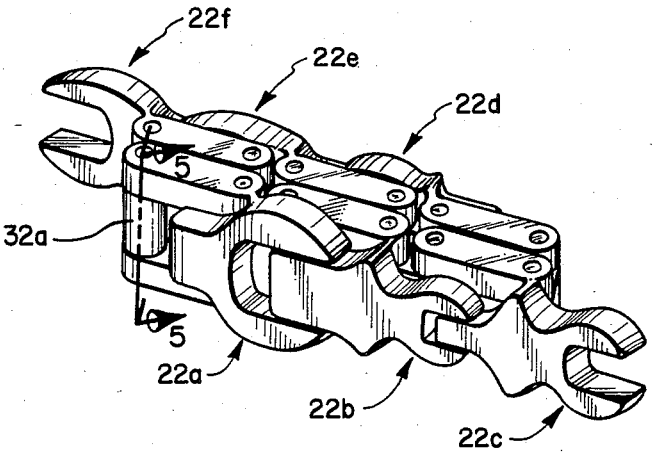
FIG. 3 is a perspective view showing the chained tool set of FIG. 2 in a configuration wherein the chain has been collapsed to form a hand piece which can be used to operate a selected tool.
Figure 4:
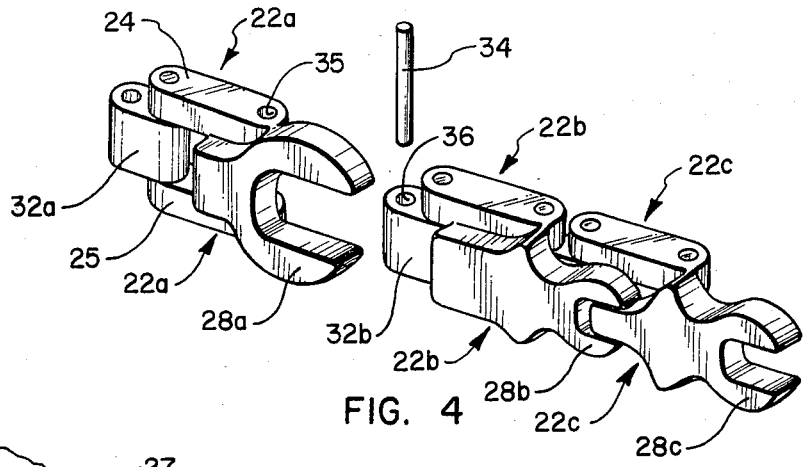
FIG. 4 is a perspective view similar to FIG. 1 wherein one of the tool links and connecting pins has been shown in exploded perspective to more fully illustrate the manner in which the various tool links are connected to form the chained tool set of the present invention.

With reference to FIGS. 1, 2 and 4, each tool link 22 comprisess two side members 24 and 25 which are attached to and formed as an integral part of the working tip of a tool. For example, as shown in FIGS. 1–4 each tool link 22 comprises a tool which is configured as a open-end wrench. Each tool has a working tip 28 which, in the case of FIGS. 1–4 consists of the mouth of the open-end wrench and a shank 26 attached at the base of the working tip 28. As shown in FIG. 1, the shank of an adjacent tool is designed in terms of its length, width and height so that it interlocks with the mouth of an adjacent tool. As hereinafter more fully described, this arrangement helps to provide strength and rigidity when the chain is folded or collapsed and used as a hand piece for purposes of applying torque or other force to a selected tool, since the torsional bending moment on the connecting pins 34 is thereby reduced.

With reference again to FIGS. 1, 2 and 4 each tool link 22 is pivotally connected to an adjacent tool link by means of connecting links 32 and pins 34. As shown best in FIG. 4, the pins 34 are inserted through holes 35 which are provided at the ends of side members 24 and 25 of each tool link 22. The connecting links 32 are designed to be inserted in the space provided between side members 24 and 25, and connecting links 32 are also provided with corresponding holes 36 which receive the connecting pins 34. Pins 34 are constructed with a diameter which is large enough to provide a snug friction fit when inserted in the holes 35 and 36 of tool links 22 and connecting links 32. As hereinafter more fully described, pins 34 may be removed when it is desired to add additional tools into the chain and/or when it is desired to remove and replace worn tools.

As shown in FIG. 1, the working tip 28 of each tool extends from the end of one tool link and overlaps the end of an adjacent tool link. This helps to ensure that when the tool links 22 are connected together the pivoting action will be restrained so that the tool links will only be able to pivot in one direction. This helps to provide rigidity when using the chained tool set, particularly if the chained tool set is used in a configuration such as that illustrated in FIG. 1 where the chain is straight rather than forming a loop as in the case of FIG. 2. Thus, with the embodiment of FIG. 1, if the chained tool set 20 is held so that the open-end wrench of each tool link 22 faces downwardly, the chain will maintain a rigid, linear configuration since the tool links cannot rotate downwardly when the chained tool set 20 is in that position.

When the chained tool set 20 is connected to form an endless loop as in the case of FIG. 2, each tool link can be pivoted so as to open the chain as illustrated in FIG. 2. When a particular tool is selected the chain can then be folded or collapsed as shown in FIG. 3 to form two parallel rows of tool links which serve as a rigid hand piece that is very strong and which can be firmly grasped when applying the torque or other force necessary to operate the tool. It will also be appreciated as illustrated in FIG. 3 that when so collapsed, the tool 22*f* and 22*c* at either end of the collapsed chain may be in a working position similar to a conventional open-end wrench. Another advantage provided by the hand piece which is formed when the chain is collapsed as shown in FIG. 3 arises from the fact that the hand piece typically has a thickness much greater than a typical wrench and therefore is much easier to grip so that greater force can be applied. It should also be noted that in the embodiment of FIG. 1 wherein the chain is straight rather than being connected as a loop, the chain can still be folded over to form a hand piece having at least two parallel rows of tool links as depicted in FIG. 3.

Figure 5:
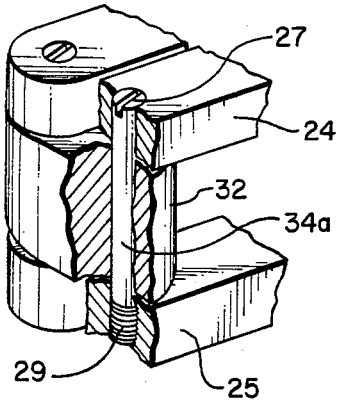
FIGS. 5–7 are enlarged perspective views showing portions of a tool link which have been broken away to more fully illustrate alternative structures for linking the chain such that tool links can be disconnected one from the other for purposes of adding or replacing tool links in the chain.
Figure 6:
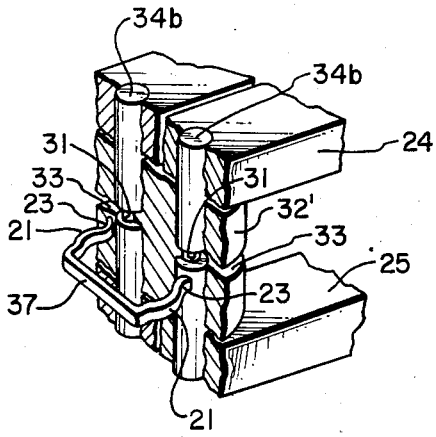
Figure 7:
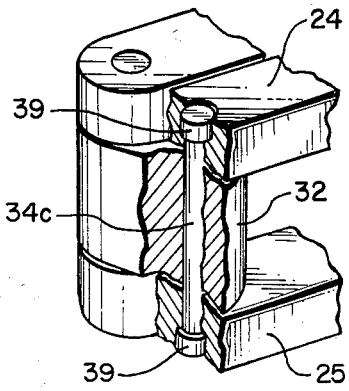

FIGS. 5, 6 and 7 each illustrate alternative ways in which adjacent tool links 22 can be connected. As shown in FIG. 5, the pin 34*a* may be threaded at one end 29 and provided with a slot 27 at the other end thereof so that the pin 34*a* can be screwed into one of the side members 25. When it is desired to add additional tool links or to replace worn tools the pin 34*a* can then be unscrewed and removed so as to disconnect the tool links.

An alternative arrangement for connecting adjacent tool links is shown in FIG. 6. As there illustrated, each connecting pin 34*b* is provided with a notch 31 and each connecting link 32' is provided with a corresponding slot 33 so that a retainer clip 37 can be clipped onto the connecting link 32' to engage the notch 31 of each connecting pin 34*b*. Retaining clip 37 is formed on its sides so that the leading ends 23 are bent inwardly whereas the middle portion 21 of the sides are bowed out, thus providing a compression or spring-like action which holds the retaining clip 37 in place once the portions 21 engage the notches 31 of connecting pins 34*b*. The retaining clip 37 can then be removed when it is desired to remove the connecting pins 34*b* for purposes of adding or replacing tools in the chain.

In the alternative embodiment shown in FIG. 7, the connecting pin 34*c* is designed so as to permanently connect adjacent tool links. Connecting pin 34*c* comprises enlarged head members 39 at opposite ends thereof which may be formed after insertion of the pin by any of several techniques which are common in the art. Thus, in the embodiment of FIG. 7, once the tool links are connected to form the chain, they may not be removed or replaced. It will therefore be appreciated that the chained tool set of the present invention may be provided with tool links which are either capable of being disconnected or which are permanently attached to one another.

As mentioned in the background portion of this specification, at times it may be necessary or desirable to use selected combinations of tools for certain jobs. For example, it may be desirable to provide a customized tool set which would be particularly suitable for cyclists. Included in such a tool set would be times such as a spoke wrench, bearing spanner wrenches; a box-end wrench for pedal crank hubs and so forth. As will be appreciated, using the connecting pin arrangement as illustrated in FIGS. 1–4 or as shown in FIGS. 5 and 6, it is possible to easily change or replace the type of tools provided on the chain wrench so that a customized tool set can be provided. In some applications, it may also be desirable to provide customized tool sets for use in assembling and/or maintaining certain types of machinery or equipment. In those instances, specially designed tool sets may be provided using embodiments of the present invention which either provide for interchangeability of tool links as in the case of the embodiments of FIGS. 1–6, or using tool links which are permanently joined and are not interchangeable as in the case of the embodiment of FIG. 7. In either case, it is within the scope of the present invention to provide chained tool sets which comprise either the same type of tool with the size of the tools varying or a combination of different types of tools as shown and as described more fully below in connection with the embodiments illustrated in FIGS. 9–10.

Figure 8:
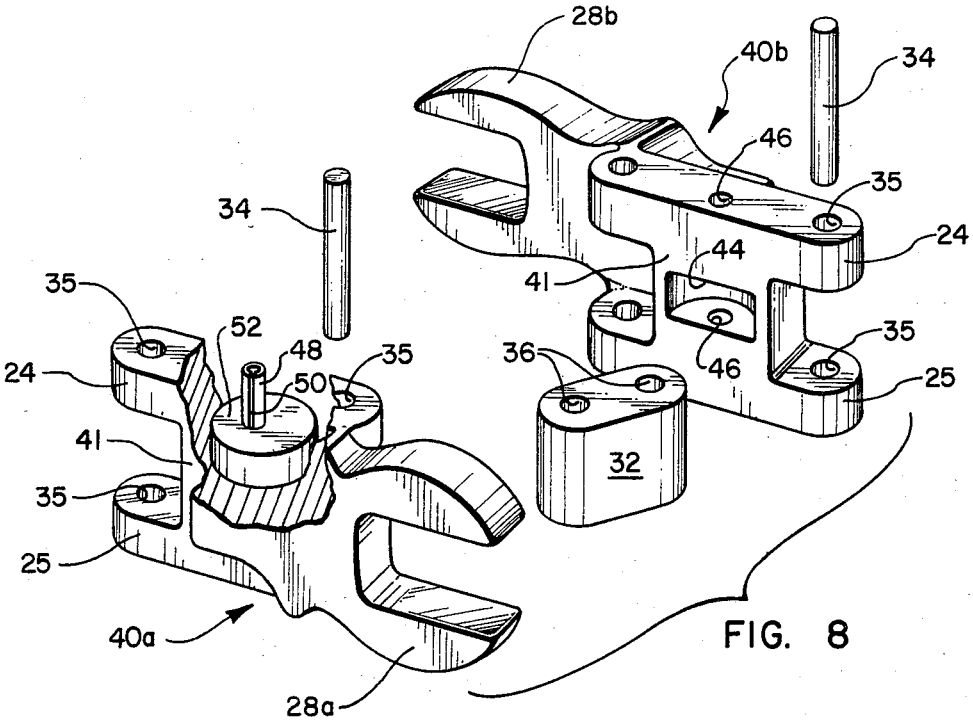
FIG. 8 is an exploded perspective view with portions broken away so as to illustrate yet another embodiment of a tool link that may be used in the present invention.

Reference is next made to FIG. 8. FIG. 8 illustrates another embodiment of a tool link which can be used to increase the rigidity and strength of the hand piece that is formed when the chain is collapsed as shown in FIG. 3. In FIG. 8, two tool links are generally designated at 40*a* and 40*b*. Each tool link 40 comprises a working tip 28, which in FIG. 8 is shown as an open-end wrench as illustrated at 28*a* and 28*b*, respectively. As in the case of the previously described embodiments, each tool link 40 is formed as an integral piece. However, unlike the embodiments described above, in FIG. 8 each tool link 40 is constructed so that the side members 24 and 25 are joined to each other by a support member 41 formed toward the middle and between side members 24 and 25. The support member 41 has a semicircular slot 44 formed in it.

As shown in connection with tool link 40*a* which is illustrated to the left in FIG. 8, a circular disk 52 may be provided in the slot 44 of every other tool link 40. The circular disk 52 is secured within the slot 44 by means of a retaining pin 48 which is received through holes 46 formed in the top and bottom of the semicircular slot 44, as shown best in tool link 40*b* of FIG. 8. Retaining pin 48 may comprise a compression type pin constructed of spring steel with a seam-like gap 50 formed along its length which allows the retaining pin 48 to be compressed and inserted into the holes 46 provided at the top and bottom of the semicircular slot 44 as well as the corresponding hole provided in the disk 52.

The disk 52 functions as a key which engages the semicircular slot 44 of an adjacent tool link. Accordingly, as shown best in the cross-sectional view of FIG. 10, when the chain is collapsed to form the hand piece which is gripped for purposes of operating a tool, the disk 52 engages the semicircular slot 44 of the adjacent tool link which then serves to hold the adjacent tool links so as to prevent them from slipping either longitudinally or laterally with respect to one another. As will be appreciated, this serves to provide additional strength and rigidity to the hand piece when using a selected tool. Moreover, the additional support member 41 which connects the side members 24 and 25 of each tool link 40 serves to provide additional strength and rigidity.

In the embodiment of FIGS. 9 and 10, each tool link 60*a*–60*f* of the chained tool set is similar to the tool links 40*a* and 40*b* described in FIG. 8, except with respect to the manner in which the working tips 62*a*–62*f* are secured to the tool links. In the embodiment of FIGS. 9 and 10, each tool link 60 is provided with a pair of arms 64 and 65 which extend outwardly and are formed as integral parts of the side members 24 and 25 of each link. The arms 64 and 65 are each provided with holes at their forward ends which receive a pivot pin 68 which is used to secure the tool between the arms 64 and 65. Thus, each tool comprises a suitable base 66 which has a bore through the base for receiving the pivot pin 68. Extending from the base 66*a* of each tool is the working tip 62*a* for the particular type of tool desired. Thus, as shown in FIG. 9 tool 62*a* is a conventional screwdriver tip, tool 62*b* is a conventional socket drive, tool 66*c* has a working tip formed as a conventional allen wrench, tool 62*e* (FIG. 10) is a phillips screwdriver tip and tool 62*f* has a working tip formed as a box-end wrench. In each case the base 66 of the tool is designed to swivel about the pivot pin 68 which secures the tool base 66 between the arms 64 and 65 of the tool link 60. Thus, as illustrated by the phantom line position for allen wrench 62*c* in FIG. 9, each tool may be positioned in one of several positions when using the tool to perform work.

As shown best in FIG. 10, the position for each tool is secured by means of the pivot pin 68, which is provided with a plurality of detents 70 about its periphery. The detents 70 are engaged by a ball 72 that is held by a spring 74. Spring 74 in turn is secured by a threaded plug 76 which may be screwed into a bore 78 provided along the length of the arms 64 and 65. Accordingly, each tool will click into position as it is swiveled about the pivot pin 68 to a point where the ball 72 will engage one of the detents 70 provided on the pivot pin 68. As will be appreciated, the embodiment of FIG. 9 therefore has the added advantage that any tool provided on the chained tool set can be moved to a working position rather than having to move the particular tool to the end of the chain as in the case of the embodiments previously described. Thus, for example, screwdriver 62*a* could also be swiveled about the pivot pin 68 to the same position shown by allen wrench 62*c* so that either tool could be used without having to move the screwdriver 62*a* to the end of the chain.

Figure 11:
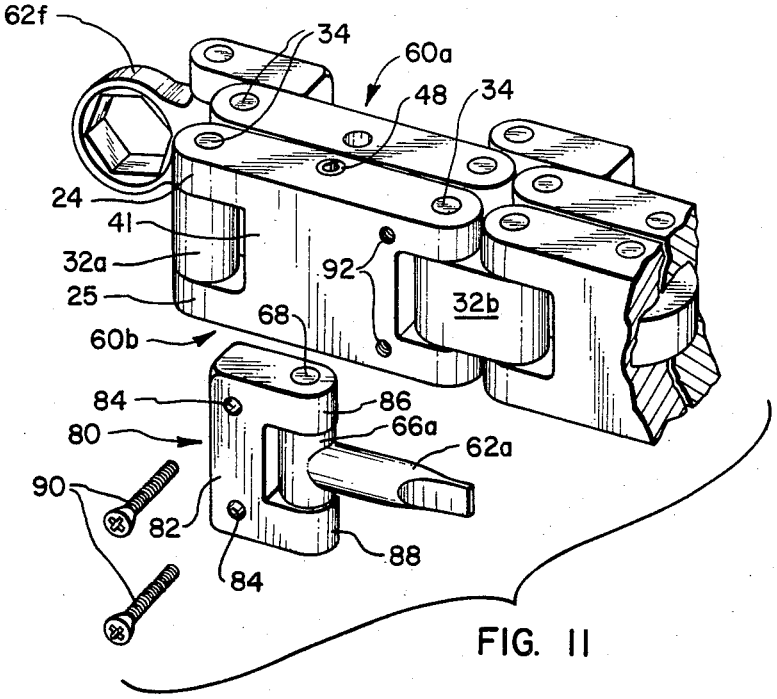
FIG. 11 is an exploded perspective view illustrating still another embodiment of the present invention.

In the embodiment of FIG. 11, each tool link 60 is essentially the same as the tool links described in FIGS. 9 and 10 except that in the embodiment of FIG. 11 the arms 86 and 88 to which the working tips 62 are secured are mounted to the tool link by means of screws 90. As shown in FIG. 11, the arms 86 and 88 between which the base 66 of the tool are pivotally secured by pin 68 are formed as part of a C-shaped member 82. Member 82 is provided with holes 84 through which the screws 90 engage threaded holes 92 provided on the side members 24 and 25 of the tool link. This embodiment thus provides an alternative arrangement which permits different types of tools to be quickly and easily changed on the chain.

From the foregoing, it should be appreciated that the present invention thus provides a versatile tool set comprised of tool links connected together to form a chain which provides in a single hand piece a plurality of tools which can be changed in rapid succession from one tool to the other. The chained tool set of the present invention is compact and versatile in that the various tools can be replaced and/or additional tools can be added to the chain, and is convenient since there are no loose parts in the tool set which can be lost or misplaced. In use, any tool can be selected and used without the need for removing, reconnecting or replacing parts on the hand piece. Selected combinations of tools may be attached to the chain for purposes of providing specific tool sets for any given application which requires a combination of tools.

The present invention may be embodied in another specific forms without departing from its spirit or essential characteristics. The described embodiments are to be considered in all respects only as illustrative and not restrictive, and the scope of the invention is therefore indicated by the appended claims rather than by the foregoing description. All changes which come within the meaning and range of equivalency of the claims are to be embraced within their scope.

What is claimed and desired to be secured by U.S. Letters Patent is:

1. A versatile tool set comprising:

at least three or more tools each comprising a working tip and means for linking said tools together to form a chain wherein each said working tip is attached to wherein said working tips and linking means are connected from front end to back end so as to be each oriented in the same direction; and means for connecting said linking means such that each said linking means is pivotally connected to at least one adjacent linking means, whereby said chain is operable so as to be foldable into two parallel, abutting rows of tools which thereby form an essentially rigid hand piece having at least one said working tip extending from the hand piece so as to be operable on a workpiece.

2. A tool set as defined in claim 1 wherein each said tool further comprises a shank attached to said working tip, the shank of each said tool being adapted to interlock with the working tip of an adjacent tool when said chain is folded to form said rigid hand piece, said interlocking shanks and working tips providing additional strength and rigidity to said hand piece.

3. A tool set as defined in claim 1 wherein each said working tip is the same type of working tip and differs from the other working tips only in size.

4. A tool set as defined in claim 1 wherein said tools comprise a plurality of different types of working tips for performing different tasks.

5. A tool set as defined in claim 1 wherein each said means for linking said tools together comprises a tool link comprising first and second side members spaced one from the other at the ends thereof and essentially parallel one with the other.

6. A tool set as defined in claim 5 wherein each said tool link is integrally joined to one of said working tips.

7. A tool set as defined in claim 5 further comprising means for pivotally mounting at least one or more of said working tips to said tool links.

8. A tool set as defined in claim 7 wherein said means for pivotally mounting said working tips comprises a pair of arms extending from said side members and a pivot pin extending between said arms, said pivotally mounted working tips each comprising a base mounted on said pivot pin.

9. A tool set as defined in claim 7 wherein said means for pivotally mounting said working tips comprises a bracket comprising two arms and a pin extending between said arms, each said pivotally mounted working tip comprising a base which is mounted to said pin, said bracket further comprising means for mounting said bracket to a tool link.

10. A tool set as defined in claims 8 or 9 further comprising means for securing said pivot pin in one of a plurality of positions as said working tip is rotated with said pivot pin.

11. A tool set as defined in claim 10 wherein said means for securing said position of said pivot pin as said working tip is rotated comprises a ball adapted to engage one of a plurality of detents formed on said pivot pin, said ball being secured by a spring mounted in a bore formed in at least one of said arms, said spring being secured in said bore by a plug member.

12. A tool set as defined in claim 5 wherein said means for connecting said tool links comprises a plurality of connecting links each secured at opposite ends thereof between said side members by a connecting pin extending between said side members and through said connecting link.

13. A tool set as defined in claim 12 further comprising means for releasably securing at least some of said connecting pins so that at least some of said tool links can be disconnected from said chain.

14. A tool set as defined in claim 13 wherein said means for releasably securing said connecting pins comprises a threaded end provided on one or more of said connecting pins so that said connecting pins with said threaded ends can be screwed into or out of a corresponding threaded bore in one of said side members of said tool links.

15. A tool set as defined in claim 13 wherein said means for releasably securing said connecting pins comprises a notch formed on one or more of said connecting pins, a slot formed on a corresponding connecting link and a spring clip for engaging said notch through said slot.

16. A tool set as defined in claim 5 wherein each said tool link comprises a support member integrally joined between said first and second side members, each support member comprising a slot formed in a face thereof, and every other one of said tool links further comprising means for engaging said slot when said tool links are folded to form two rows of tool links which are parallel to each other.

17. A tool set as defined in claim 16 wherein said means for engaging said slot comprises a key secured in the slot of said every other tool link.

18. A tool set as defined in claim 1 wherein said linking means are connected to form an endless loop.

19. A chained tool set comprising:

at least three or more tool links each comprising side arms and a tool having a working tip attached essentially parallel and to a side of said arms so as to overlap an end of the side arms of an adjacent tool link, thereby preventing said tool links from folding in any but one direction so that each said working tip will be outwardly oriented when said tool links are folded;

a plurality of connecting links each pivotally connected between a pair of adjacent tool links; and a plurality of connecting pins pivotally securing each said connecting link between each said pair of adjacent tool links so as to chain said tool links together end-to-end, said chain being operable to fold said tool links into a working configuration having at least two parallel, abutting rows of tools which form an essentially rigid hand piece having at least one working tip extending therefrom for use on a workpiece.

20. A tool set as defined in claim 19 wherein each said tool further comprises a base, and further comprising means for pivotally connecting the base of each said tool to one of said tool links, each said tool being pivotal to any one of several positions when so connected to said tool link.

21. A tool set as defined in claim 20 wherein said means for pivotally connecting the base of each said tool to one of said tool links comprises a pair of arms attached to said tool links and a pivot pin extending between said arms, said base of each said tool being mounted on said pivot pin so as to be rotatable therewith.

22. A tool set as defined in claim 20 wherein said means for pivotally connecting said base of each said tool to one of said tool links comprises a bracket comprises two arms and a pivot pin mounted between said arms, each said base being mounted on one of said pivot pins so as to be rotatable therewith, said bracket further comprising means for mounting said bracket to one of tool links.

23. A tool set as defined in claims 21 or 22 further comprising means for securing said pivot pin in one of a plurality of positions as said working tip is rotated with said pivot pin.

24. A tool set as defined in claim 23 wherein said means for securing said position of said pivot pin as said working tip is rotated comprises a ball adapted to engage one of a plurality of detents formed on said pivot pin, said ball being secured by a spring mounted in a bore formed in at least one of said arms, said spring being secured in said bore by a plug member.

25. A tool set as defined in claim 19 wherein each said tool link further comprises first and second side members spaced one from the other at the ends thereof and essentially parallel one with the other.

26. A tool set as defined in claim 25 wherein each said connecting link is mounted between said first and second side members at one end of each said tool link, and wherein said first and second side members and said connecting link are each provided with a bore for receiving said connecting pins.

27. A tool set as defined in claim 26 further comprising means for releasably securing each said connecting pin so that said tool links can be disconnected from said chain.

28. A tool set as defined in claim 27 wherein said means for releasably securing said connecting pins comprises a threaded end provided on one end of each said connecting pin and a corresponding threaded bore provided in one of said side members of each said tool link so that each said connecting pin can be screwed into or out of said corresponding threaded bore.

29. A tool set as defined in claim 27 wherein said means for releasably securing said connecting pins comprises a notch formed on each said connecting pin and a slot formed on each said connecting link, and a spring clip for engaging said notch through said slot.

30. A tool set as defined in claim 19 wherein each said tool further comprises a shank attached to said working tip, the shank of each said tool being adapted to interlock with the working tip of an adjacent tool when said chain is folded to form said rigid hand piece, said interlocking shanks and working tips providing additional strength and rigidity to said hand piece.

31. A tool set as defined in claim 19 wherein said tool links are each connected by said connecting links and said connecting pins so as to form a closed loop.

32. A tool set as defined in claim 19 wherein each said working tip is the same type of working tip and differs from the other said working tips only in size.

33. A tool set as defined in claim 19 wherein said tools comprise a plurality of different types of working tips for performing different tasks.

34. A tool set as defined in claim 19 wherein each said tool is integrally joined to one of said tool links.

35. A tool set as defined in claim 25 wherein each said tool link further comprises a support member integrally joined between said first and second side members, each support member comprising a slot formed in a face thereof, and every other one of said tool links in said chain further comprising means for engaging said slot when said tool links are folded to form said parallel rows of said hand piece.

36. A tool set as defined in claim 35 wherein said means for engaging said slot comprises a disk secured in the slot of said every other tool link and a retainer pin for securing said disk in said slot.

37. A versatile tool set comprising:

a plurality of tool links;

a plurality of tools each comprising a working tip and a base;

first means for pivotally connecting the base of each said tool to a side of one of said tool links, each said tool being pivotal to any one of several positions when so connected to said tool link; and second means for pivotally connecting each said tool link to at least one adjacent tool link to form a chain with said tools and tool links connected end-to-end and each oriented in the same direction, said chain being operable to fold said tools and tool links into at least two parallel, abutting rows to form an essentially rigid hand piece that may be grasped when applying force to operate a selected tool.

38. A tool set as defined in claim 37 wherein said tool links each comprise first and second side members spaced one from the other at the ends thereof and wherein said first means comprises a pair of arms extending from said side members and a pivot pin rotatably mounted between said arms, the base of each said tool being mounted to said pivot pin so as to rotate therewith.

39. A tool set as defined in claim 37 wherein each said tool link comprises first and second side members which are parallel to one another and which are spaced one from the other at the ends thereof, and wherein said first means comprises a bracket comprising two arms and a pivot pin rotatably mounted between said arms, the base of each said tool being mounted on one of said pivot pins and rotatable therewith, each said bracket further comprising means for mounting said bracket to one of said tool links.

40. A tool set as defined in claims 38 or 39 further comprising means for securing said pivot pin in one of a plurality of positions as said working tip is rotated with said pivot pin.

41. A tool set as defined in claim 40 wherein said means for securing said position of said pivot pin comprises a ball adapted to engage one of a plurality of detents formed on said pivot pin, said ball being secured by a spring mounted in a bore formed in at least one of said arms, said spring being secured in said bore by a plug member.

42. A tool set as defined in claim 37 wherein each said tool link comprises first and second side members which are parallel with one another and which are spaced one from the other at the ends thereof, and wherein second means comprises a plurality of connecting links each secured at opposite ends thereof between said side members by a connecting pin mounted between said side members and through said connecting link.

43. A tool set as defined in claim 42 further comprising means for releasably securing each said connecting pin so that said tool links can be disconnected from said chain when it is desired to remove, replace or add new tool links to said chain.

44. A tool set as defined in claim 43 wherein said means for releasably securing said connecting pins comprises a threaded end provided on one or more of said connecting pins so that said connecting pins with said threaded ends can be screwed into or out of a corresponding threaded bore in one of said side members of said tool links.

45. A tool set as defined in claim 43 wherein said means for releasably securing said connecting pins comprises a notch formed on one or more of said connecting pins, a slot formed on a corresponding connecting link and a spring clip for engaging said notch through said slot.

46. A tool set as defined in claim 37 wherein each said tool link comprises first and second support members spaced one from the other at the ends thereof and essentially parallel one with the other, and further comprising a support member integrally joined between said first and second side members, each support member comprising a slot formed in a face thereof, and every other one of said tool links in said chain further comprising means for engaging said slot when said tool links are folded to form said parallel rows of tool links.

47. A tool set as defined in claim 46 wherein said means for engaging said slot comprises a key secured in the slot of said every other tool link.

48. A tool set as defined in claim 37 wherein said linking means are connected to form an endless loop.

49. A chained tool set comprising:

a plurality of tools each comprising a working tip and means for linking said tools together, each said working tip being attached to a side of one of said linking means;

means for pivotally connecting said linking means from front end to back end so as to orient said tools in the same direction and so as to chain said tools together, said chain being operable to fold said linking means to form an essentially rigid hand piece formed by at least two parallel, abutting rows of tools when so folded; and means for releasably securing said pivotally connecting means so as to uncouple said linking means when it is desired to remove, replace or add a tool to said chain.

50. A tool set as defined in claim 49 wherein each said tool further comprises a shank attached to said working tip, the shank of each said tool being adapted to interlock with the working tip of an adjacent tool when said chain is folded to form said rigid hand piece, said interlocking shanks and working tips providing additional strength and rigidity to said hand piece.

51. A tool set as defined in claim 49 wherein said tools comprise a plurality of different types of working tips for performing different tasks.

52. A tool set as defined in claim 49 wherein said linking means are connected to form an endless loop.

53. A tool set as defined in claim 49 wherein each said means for linking said tools together comprises a tool link comprising first and second side members spaced one from the other at the ends thereof and essentially parallel one with the other.

54. A tool set as defined in claim 53 further comprising means for pivotally mounting at least one or more of said working tips to said tool links.

55. A tool set as defined in claim 54 wherein said means for pivotally mounting said working tips comprises a pair of arms extending from said side members and a pivot pin extending between said arms, said pivotally mounted working tips each comprising a base mounted on said pivot pin.

56. A tool set as defined in claim 54 wherein said means for pivotally mounting said working tips comprises a bracket comprising two arms and a pin extending between said arms, each said pivotally mounted working tip comprising a base which is mounted to said pin, said bracket further comprising means for mounting said bracket to one of said tool links.

57. A tool set as defined in claim 55 or 56 further comprising means for securing said pivot pin in one of a plurality of positions as said working tip is rotated with said pivot pin.

58. A tool set as defined in claim 57 wherein said means for securing said position of said pivot pin as said working tip is rotated comprises a ball adapted to engage one of a plurality of detents formed on said pivot pin, said ball being secured by a spring mounted in a bore formed in at least one of said arms, said spring being secured in said bore by a plug member.

59. A tool set as defined in claim 53 wherein said means for pivotally connecting said linking means comprises a plurality of connecting links each secured at opposite ends thereof between said side members by a connecting pin extending between said side members and through said connecting link.

60. A tool set as defined in claim 59 wherein said means for releasably securing said pivotally connecting means comprises means for releasably securing at least some of said connecting pins so that at least some of said tool links can be disconnected from said chain.

61. A tool set as defined in claim 60 wherein said means for releasably securing said connecting pins comprises a threaded end provided on one or more of said connecting pins so that said connecting pins with said threaded ends can be screwed into or out of a corresponding threaded bore in one of said side members of said tool links.

62. A tool set as defined in claim 60 wherein said means for releasably securing said connecting pins comprises a notch formed on one or more of said connecting pins, a slot formed on a corresponding connecting link and a spring clip for engaging said notch through said slot.

63. A tool set as defined in claim 53 wherein each said tool link comprises a support member integrally joined between said first and second side members, each support member comprising a slot formed in a face thereof, and every other one of said tool links in said chain further comprising means for engaging said slot when said tool links are folded to form two rows of tool links which are parallel to each other.

64. A tool set as defined in claim 63 wherein said means for engaging said slot comprises a key secured in the slot of said every other tool link.

65. A chained tool set comprising:

a plurality of tool links each comprising a pair of side members and a tool mounted on said side members toward one end thereof, each said tool comprising a working tip that overlaps the end of the side members of an adjacent tool link when said working tip is not in use, thereby restraining the pivoting action so that said tool links are pivotal in only one direction;

a plurality of connecting links each secured at one end thereof by a pin extending between said side members of a tool link so that each said tool link is pivotally connected to an end of at least one adjacent tool link to form a chain that is foldable by said pivoting action into an essentially rigid hand piece having at least one working tip extending from an end thereof for engaging a workpiece; and means for releasably securing each said pin so that each said pin can be removed to disconnect said tool links when it is desired to remove, replace or add a tool to said chain.

66. A versatile tool set comprising:

a plurality of tools each comprising a working tip and means for linking said tools together to form a chain wherein said tools and said linking means are connected end-to-end so as to be oriented in the same direction; and means for connecting said linking means such that each said linking means is pivotally connected to at least one adjacent linking means to form an endless loop, and wherein said chain is operable so as to be folded to form an essentially rigid hand piece having two abutting rows of tools with at least one of said working tips extending from an end of said hand piece so as to be operable on a workpiece.

67. A chained tool set comprising:

a plurality of tool links each comprising a tool having a working tip at one end thereof and a shank at the other end thereof, each said working tip and shank being attached to one of said tool links as an integral part thereof;

a plurality of connecting links each pivotally connected between a pair of adjacent tool links; and a plurality of connecting pins pivotally securing each said connecting link between each said pair of adjacent tool links so as to chain said tool links together, the shank of each said tool being adapted to interlock with the working tip of an adjacent tool, and said chain being operable to fold said tool links into a working configuration having at least two parallel, abutting rows of tools which when so folded form an essentially rigid hand piece having at least one working tip extending from an end thereof so as to be operable on a workpiece.

68. A versatile tool set comprising:

a plurality of tools each comprising a working tip and means for linking said tools together to form a chain wherein said linking means are connected end-to-end;

means for connecting said linking means such that each said linking means is pivotally connected to at least one adjacent linking means, and wherein said chain is operable so as to be foldable to form an essentially rigid hand piece having two parallel, abutting rows of tools which are folded together with at least one said working tip extending from one end thereof so as to be operable on a workpiece; and each said linking means comprising a slot formed on a face thereof and every other one of said linking means further comprising key means for engaging said slot when said chain is folded into said parallel, abutting rows of tools, thereby maintaining said rows parallel in relation to one another.

* * * * *

UNITED STATES PATENT AND TRADEMARK OFFICE

CERTIFICATE OF CORRECTION

PATENT NO. : 4,606,247

DATED : August 19, 1986

INVENTOR(S) : Charles H. Graham

It is certified that error appears in the above-identified patent and that said Letters Patent are hereby corrected as shown below:

Column 7, line 34, after "attached to" add the following: --a side and is part of said linking means and--

Column 3, line 37, "a" should be --an--

First page, Assignee should be --Scott H. Hogan, Bountiful, Utah--

Signed and Sealed this

Thirtieth Day of December, 1986

*Attest:*

DONALD J. QUIGG

*Attesting Officer*

*Commissioner of Patents and Trademarks*